US005388862A

United States Patent [19]

Edwards

[11] Patent Number: 5,388,862

[45] Date of Patent: Feb. 14, 1995

[54] SECURITY ARTICLES

[75] Inventor: David Edwards, Basingstoke, United Kingdom

[73] Assignee: Portals Limited, Basingstoke, United Kingdom

[21] Appl. No.: 64,045

[22] PCT Filed: Dec. 3, 1993

[86] PCT No.: PCT/GB91/02140

§ 371 Date: May 19, 1993

§ 102(e) Date: May 19, 1993

[87] PCT Pub. No.: WO92/10608

PCT Pub. Date: Jun. 25, 1992

[30] Foreign Application Priority Data

Dec. 4, 1990 [GB] United Kingdom ..... 9026379

[51] Int. Cl.[6] ..... D21H 21/42; D21H 21/48

[52] U.S. Cl. ..... 283/82; 283/83; 283/91; 283/113; 283/901

[58] Field of Search ..... 283/82, 83, 91, 113, 283/901

[56] References Cited

U.S. PATENT DOCUMENTS

| | | | |
|---|---|---|---|
| 3,897,964 | 8/1975 | Oka et al. | 283/91 X |
| 4,066,280 | 1/1978 | Lacapria | 283/91 |
| 4,504,083 | 3/1985 | Dervrient et al. | 283/91 X |
| 4,591,189 | 5/1986 | Holmen et al. | 283/83 |
| 4,897,300 | 1/1990 | Boehm | 428/195 |
| 4,941,687 | 7/1990 | Crane . | |
| 5,093,184 | 3/1992 | Edwards | 283/114 |

FOREIGN PATENT DOCUMENTS

| | | | |
|---|---|---|---|
| 319157 | 6/1989 | European Pat. Off. . | |
| 0453131 | 10/1991 | European Pat. Off. . | |
| 2001944 | 7/1971 | Germany | 283/83 |
| 2233602 | 1/1991 | United Kingdom | 283/114 |
| 8910269 | 11/1989 | WIPO | 283/83 |

*Primary Examiner*—Frances Ham

*Attorney, Agent, or Firm*—Watson, Cole, Grindle & Watson

[57] ABSTRACT

A security article such as a banknote, credit card, identity card or travel document includes a security element which is visually detectable in transmitted light to display portions which transmit light and portions which are opaque, the security element including a plurality of layers that include a light-transmitting support layer and two or more series of opaque regions. The arrangement of the opaque regions is such that at certain parts of the security element the regions overlap to prevent light transmission and elsewhere along its length the opaque regions do not overlap or only partially overlap such that light transmission through the security element occurs.

35 Claims, 2 Drawing Sheets

SECURITY ARTICLES

BACKGROUND OF THE INVENTION

1. Field of the Invention

This invention is concerned with security paper for banknotes, cheques and like documents and also with other security articles including credit cards or like plastic articles which are required to provide a high degree of security against imitations.

2. The Prior Art

It is widely known to use in banknotes and other security documents, security devices such as security elements, e.g. security threads or security strips, which are made from a transparent film provided with a continuous reflective metal layer, such as aluminium, which is vacuum deposited on, for example, polyester film. Banknotes made from such paper have been in general circulation in many countries for many years. When security devices are embedded in the security paper and the paper is subsequently printed to provide the security documents, the thread cannot be readily discerned in reflective light but is immediately transparent as a dark image when the document is viewed in transmitted light.

Further, in our previous British patent specification No 1,095,286 there is described and claimed a security device for use in security paper comprising a continuous fine security ribbon having a width of substantially 0.75 mm and having printed thereon a design, lettering or pattern comprising printed characters of a height of substantially 0.4 mm. The security ribbon described in GB 1,095,286 may be made of metal foil which may be aluminium and furthermore may be in the form of a laminate; the printed design, lettering or pattern as disclosed in the specification is very small, i.e. 0.4 mm, and is not readily visible without an aid to vision, such as a magnifying glass.

In recent times, in order to enhance the security of security documents, especially banknotes, against modern counterfeiting techniques making use of sophisticated colour separation, printing and colour photocopier technology, it has become common to use a security thread comprising a thin layer of aluminium on a plastic support which is exposed on one side of the sheet at intervals along the length of the thread, the region of exposure being referred to as a window. British Patent Specifications Nos. 1,552,853 and 1,604,463 disclosed banknotes containing such windows. Paper for use in producing such banknotes can be made using the method disclosed in our European Patent Specification No. 0 059 056. The widespread use of banknotes having security thread exposed in windows along the length of the thread has resulted in enhanced security. A banknote of this type provides added security against counterfeiters as, when viewed in transmitted light, the strip is seen as a dark line, and, when viewed in reflective light on the appropriate side, the bright shiny aluminium portions which are exposed at the windows are readily visible. However, there is a need for even greater security for banknotes and like documents whether or not the security device is exposed in windows.

The present invention therefore is concerned with providing a novel security element, which may be in the form of a strip or thread, of enhanced security to provide security paper for banknotes, cheques and the like which is even more difficult to counterfeit than present banknotes. Also the invention is concerned with security articles including credit cards, identity badges and travel tickets which comprise the novel security element of this invention.

SUMMARY OF THE INVENTION

According to the present invention there is provided a security article which comprises at least one elongate security element, the security element being visually detectable in transmitted light to display portions which transmit light and portions which are opaque, wherein the security element comprises a plurality of layers including a light-transmitting support layer and two or more series of opaque regions which are separated by at least one light transmitting layer, which may be the support layer, characterised in that the opaque regions are arranged such that at certain parts of the security element the said regions overlap to prevent light transmission and elsewhere along the length of the security element the opaque regions do not overlap or partially overlap such that light transmission through the security element can occur.

By the term "opaque regions" it is to be understood that such regions in the security element transmit significantly less light when viewed with the naked eye in comparison to the transmissive regions of the security element between such opaque regions and in comparison with the regions of the security paper, etc. adjacent to the security element.

Preferably the security article is security paper and the security element is either wholly embedded within the paper, or is partially embedded within said paper with portions thereof being exposed at the surface of the paper at spaced intervals along the length of the security element at windows or apertures in the paper.

Preferably there is also present between the series of opaque regions at least one and preferably two thin layers of metal, which layer or layers has a combined optical density of 0.1 to 1.2, preferably from 0.3 to 0.9. Such a thin layer of metal, if made of aluminium, which is preferred, serves to render the security element less visible when viewed in reflected light. In one embodiment in the paper the security element of this invention when viewed in reflected light has characteristics not significantly different from the prior art security element made from vacuum deposition of aluminium on to a polyester support, although, of course, the appearance of the security element of this invention is radically different when viewed with transmitted light.

In a preferred embodiment of the invention security paper includes a security element formed from two parts, one part bearing on one side of a light-transmitting support layer opaque, spaced-apart regions of aluminium and on the other side of the support layer a thin film of aluminium, which part is adhered another part which comprises a light-transmitting support layer having on one side a thin film of aluminium, the two layers of thin aluminium having a combined optical density of 0.15 to 1.0, and on the other side of the support layer opaque spaced-apart regions of aluminium, said two parts being united with an adhesive layer positioned between the two thin layers of aluminium.

In one embodiment the opaque regions on one side of the security element have a width equal to the gap between said opaque regions and the other opaque regions have an equal width and gap which is 5 to 15% larger than the width of the first opaque regions. The support layer, which preferably is a clear polymer, such as polyethylene terephthalate, may comprise a light-transmitting coloured and/or luminescent substance.

In another form of the invention security paper includes a security element which comprises a support layer having on one side a first series of opaque regions which are provided with a light-transmitting coating to encapsulate said opaque regions, said coating being bonded to a second coating which encapsulates a second series of opaque regions, which second series of opaque regions has a second support layer in contact with said opaque regions.

In order to ensure better adhesion between the security element and the paper with which it is in contact, the security element may be provided with a light-transmitting adhesive layer on either or sides of the security element, and the adhesive layer may serve to encapsulate the opaque regions. The adhesive layer may comprise a coloured and/or luminescent substance.

In one form of the present invention security paper includes a security element wherein any or all of the metal components of said element are a magnetic metal. The magnetic metal may be nickel or a cobalt: nickel alloy or any other magnetic metal.

It is to be understood that the invention also includes a banknote or other security device when printed from paper in accordance with the invention. It is preferred that a banknote according to the invention includes a security element having at least ten non-light-transmitting regions, each of which is separated in the longitudinal direction along the security element by a light-transmitting region.

It is to be understood that the paper of the invention may be made from natural or synthetic fibres or mixtures thereof. Furthermore, it is to be understood that a banknote may be made from uniting or bonding two sheets, one or both of which may contain windows. In the case where there are windows present, the security element is exposed at the window; where two "windows" are in complete or partial register then the security element will be exposed at an aperture. It is to be noted further that one or both of said sheets may be made of a plastics film such that the resulting substrate which is printed to produce a banknote or other security document may be regarded as an artificial paper; such banknotes produced from plastic film are currently in use in certain countries.

In the form of the invention which relates to security articles, such as credit cards and other items which are generally of plastic and require to have good security against counterfeits, the novel security element described herein may be adhered to the plastic surface of such article or may be positioned in the surface when the article is formed. In either case the security element may be covered with a clear or a translucent plastic layer.

In the preferred form of the invention, the opaque regions on the security element are formed from vacuum deposited aluminium or other suitable metals. However, high reflectivity metallic inks (e.g. Metasheen from Johnson & Bloy Ltd., Crawley, England) or non-metallic opaque inks may be deposited by a printing technique to form such regions.

The invention will now be illustrated with reference to the following examples. It should be noted that the drawings are not to scale, and certain parts such as the metal layers have been exaggerated for the purposes of explanation.

EXAMPLE 1

Figure 1:
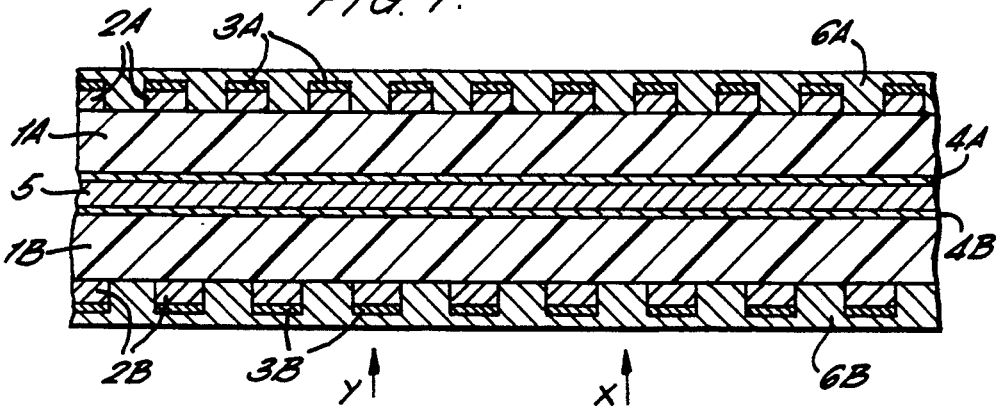
FIG. 1 is a longitudinal cross section of a security element in accordance with one embodiment of the present invention.

This example relates to the accompanying FIG. 1 of the drawings which shows in longitudinal cross section a security element in accordance with this invention. The security element is formed from two parts which are bonded together with an adhesive. Both parts include a light-transmitting support layer 1A and 1B, each of which is 12 μm in thickness and incorporates a green dye. Both support layers have opaque regions 2A and 2B of aluminium which have an optical density of from 2.0 to 2.5. This corresponds approximately to a thickness of 0.03 microns. Opaque regions 2A and 2B were formed by selectively demetallising a polyester film (e.g. EMBLET 1200) metallised with aluminium using the well known resist and etch technique which uses an agent, such as sodium hydroxide solution, to remove aluminium from the film at regions where the aluminium is exposed to the agent. Portions 3A and 3B are layers of resist positioned on the regions 2A and 2B which protect the aluminium from the etching fluid.

In this example, on the upper side of the security element the bars 2A are 1.0 mm wide and are spaced 1.0 mm apart. The opaque regions 2B on the lower side of the security element are 1.1 mm wide and are spaced 1.1 mm apart. These dimensions are in longitudinal direction along the length of the element.

The resist portions 3A and 3B may be clear or may optionally be coloured and/or luminescent (i.e. fluorescent or phosphorescent).

Regions 4A and 4B are thin layers of aluminium which are sufficiently thin so that light can be transmitted through the security element and it is appropriate for layers 4 to have a combined optical density in the range 0.15 to 1.2 and preferably 0.3 to 0.9, e.g. 0.6.

A transparent laminating adhesive 5 is positioned between the upper and lower parts which form the security element of FIG. 1; the adhesive may optionally be coloured and/or luminescent.

Transparent coatings 6A and 6B, which may also be optionally coloured and/or luminescent, provide mechanical and chemical protection by encapsulating regions of aluminium 2. Additionally the coatings 6A and 6B may provide adhesive properties to bond the security element into paper.

In one modification of the security element shown in FIG. 1 one of the thin layers of aluminium 4A and 4B can be omitted but the remaining layer should have an optical density within the range just stated above.

In a further modification of the element shown in FIG. 1, transparent coating 6A and 6B encapsulate the regions 2A and 2B and a separate adhesive layer may be employed in order to achieve optimal bonding to the paper.

A security element as illustrated in FIG. 1 may be produced by starting with a film of polyethylene terephthalate which incorporates a green dye, and then by vacuum deposition applying a layer of aluminium to one side of the film with the optical density of the aluminium layer being 2.0 to 2.5. The aluminium is then printed with a resist in a desired pattern and the resist cured by the application of heat and/or UV light. In order to demetallise the support the resulting film is flooded with hot sodium hydroxide solution of 5% concentration by weight at 60° C. employing a series of spray nozzles. By this treatment the regions of aluminium which are not protected by the cured resist are dissolved. The film is then rinsed with cold water and dried leaving the selectively metallised pattern on one side, this pattern corresponding to the pattern of the resist applied by the printing process. Thereafter a continuous layer of aluminium is applied by vacuum deposition to the other side of the polyester film, the aluminium being deposited so that an optical density of 0.3 is achieved. The resulting film is then laminated using a light-transmitting adhesive to an equivalent film having a different pattern such that at certain parts of the resulting security element opaque regions overlap opaque or light-transmitting regions to prevent light transmission and elsewhere along the length of take security elements opaque regions are positioned so as to provide regions where light transmission can take place. The film is then slit to provide narrow threads or strips which are preferably at least 0.8 mm wide, preferably from 1 to 3 mm or even up to 5 or 8 mm in width.

Figure 2:
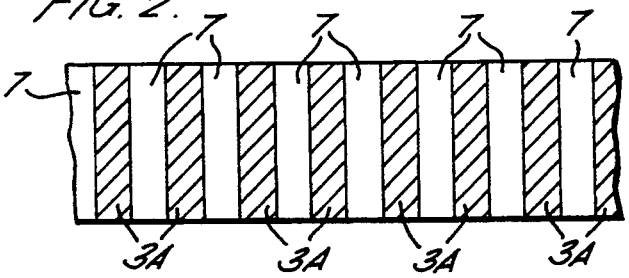
FIGS. 2–4 are plan views of a portion of the top half of the security element of FIG. 1 showing alternative patterns of resist and aluminum regions therein.
Figure 3:
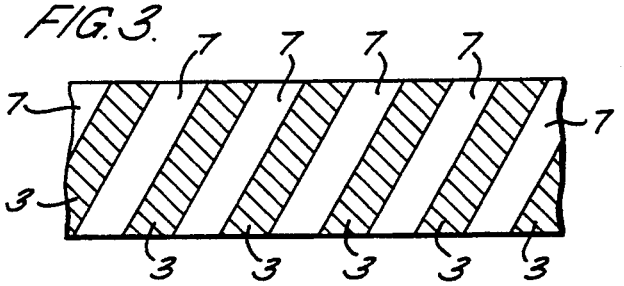
Figure 4:
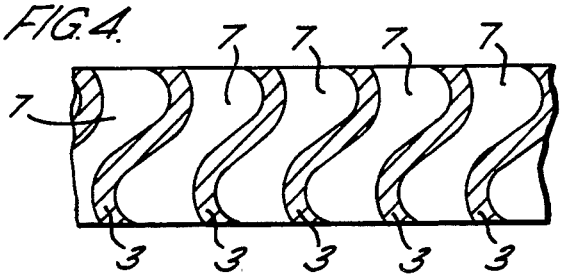

The metallised regions 2A and 2B extend across the security element and may be in a bar pattern as shown in FIGS. 2 and 3 of the accompanying drawings; also, FIG. 4 indicates an alternative pattern that can be used in practice of the invention. In FIGS. 2,3 and 4 the top half of the security element is shown in plan view to indicate suitable patterns for the aluminium regions 2A, with the resist 3A lying over the aluminium. The light transmitting areas of the top half of the element are indicated by the numeral When the security element of FIG. 1 is incorporated into paper as an embedded security thread, the metallised regions 2A and 2B have a light coloured appearance in reflected light and blend well in with the surrounding paper in a like manner to that of the well established wholly metallised thread. The gaps between regions 2A and 2B appear green in reflected light. To the naked eye the thread has the same appearance when viewed in reflected light on either side. It is to be noted that the slightly different dimensions for the bar pattern are not readily apparent and the thread appears as a series of spaced dark green rectangular regions interspersed with regions which in appearance closely match or are a little lighter than the surrounding paper. However, when the security element is viewed in transmitted light, there are regions where the metallised bars are in phase and do not significantly overlap such as indicated by the arrow at X in FIG. 1; transmitted light passes through the security element at this point and is perceived as a light green rectangle (of a lighter shade than the green perceived in reflected light) with dark opaque regions on either side in the longitudinal direction. At other points such as indicated by the arrow Y in FIG. 1 the selectively metallised bars are out of phase and overlap so no light transmission can take place, hence this is seen in transmitted light as a wholly dark region. Between the arrows at X and Y there are regions which transmit light, such regions increasing in size along the longitudinal direction. It will be appreciated that the separation between the extremes of phase X and phase Y will be a function of the size and spacing of the selectively metallised regions 2A and 2B on either side of the at least one support layer. The security element should preferably be designed to give several, e.g. at least two regions in a banknote which transmit light according to position X, but such that the separation of X and Y is at least 5 and typically 10 times the longitudinal size of the regions of aluminium 2.

In contrast to the uniformly metallised thread, a counterfeiter will not be able to simulate the overall effect by, e.g. laminating a strip of readily available foil, metallised film or hot foil stamp strip between two thin sheets of paper or by printing a line on one side of a single sheet. It is exceedingly unlikely that a counterfeiter would be able to obtain a readily available film or stamping foil which resembled the genuine thread present in a banknote produced in accordance with this invention, and especially as illustrated with reference to FIG. 1. A counterfeiter would have to resort to multiple operations. For example a counterfeiter could attempt to simulate the combined affect by printing a continuous green line on each side of a sheet of paper and then overprinting a series of rectangular blocks of an opaque white ink or ink matching the paper colour on each side, with the block size and spacing being chosen to match the relevant dimensions of the genuine thread. This technique thus involves four separate printing operations, greatly complicating the counterfeiter's task. Furthermore, there will inevitably be some misregister in the transverse direction which will result in an uneven edge to the thread when viewed in transmitted light.

Figure 5:
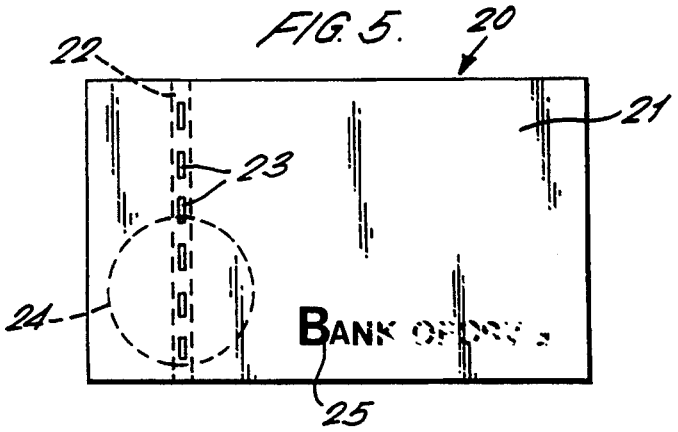
FIG. 5 is a plan view of security document made of a security paper according to the present invention.

The following description relates to FIG. 5 which is a plan of a security document made from security paper according to the invention. A security document 20, such as a banknote, comprises security paper 21 with a security thread 22. The security paper 21 has two surfaces which are used for printing to form the security document. The security thread 22 is positioned in the security paper 21 between some regions but in other regions the security thread is exposed at windows 23. The security thread also passes through a watermark 24. The surfaces of the document are provided with printing 25 to identify the document.

The thread illustrated in FIG. 1, when present in windowed paper as illustrated in FIG. 5 provides an increased visual effect. When the security element is viewed in reflected light on the windowed side, the thread appears in the windows as reflective green rectangles interspersed between reflective silver rectangles. In the fibre bridges where the security element is embedded within the paper the effect is of course similar to that of the wholly embedded thread described above. In transmitted light, the effects described above for the embedded thread apply except that the reduced fibre coverage in the window regions makes the green area at a region such as X have a lighter shade. A counterfeiter thus has the even more difficult task of simulating two metallic colours, as well as the variable transmitted light appearance. Thus the windows cannot be simulated by a foil stamping process; the counterfeiter's task is further complicated by the variation introduced by the watermark bars which are associated with the manufacturing process involving the production of windowed thread paper by the process described in our European Patent Specification No. 0 059 056.

In the modification where the portions of resist 3A and 3B contain a UV fluorescing agent which produces blue colour when subjected to UV illumination, a security element of the type illustrated in FIG. 1 will produce blue bars, and this further complicates the counterfeiter's task.

EXAMPLE 2

In a modification of the security element described above with respect to FIG. 1 the support layers 1 are colourless. In paper in the embedded and windowed form, the thread when viewed in reflected light has the appearance of a simple uniformly metallised thread, (although there may be some darkening at regions X) whereas in transmitted light regions Y are dark and opaque and regions X are light, as is the case in Example 1, but without the green colour.

EXAMPLE 3

In another modification of the security element as described above with respect to FIG. 1, parts 1,3,5 and 6 are the same as in Example 1. However, regions 2A and 2B are selectively metallised and are opaque copper with an optical density of 2.0 to 2.5 in the form of bar or other pattern. Also, the thin layers 4A and 4B are light-transmitting and are aluminium, the two layers having a combined optical density of 0.7.

This security element may be used in embedded or windowed form. In reflected light the thread has the appearance of copper bars interspersed with regions of aluminium. In transmitted light regions Y are dark and opaque whereas regions X transmit light as is the case in Example 1. In a modification of the security element of this example, regions 2A and 2B comprise opaque aluminium and regions 4A and 4B are partially transmitting continuous copper with a combined optical density of 0.7.

EXAMPLE 4

In this example the structure of Example 1 is used except that regions 4A and 4B comprise uniform dichroic layers produced by a vacuum sputtering technique. Most conveniently, only one such region 4 is included. The thread may be used in embedded or windowed form. The aluminium regions 2A and 2B have the appearance described in Example 1. The intervening regions appear green in reflected light and magenta in transmitted light; the other effects derived from the different bar size/spacing of Example 1 apply.

EXAMPLE 5

Figure 6:
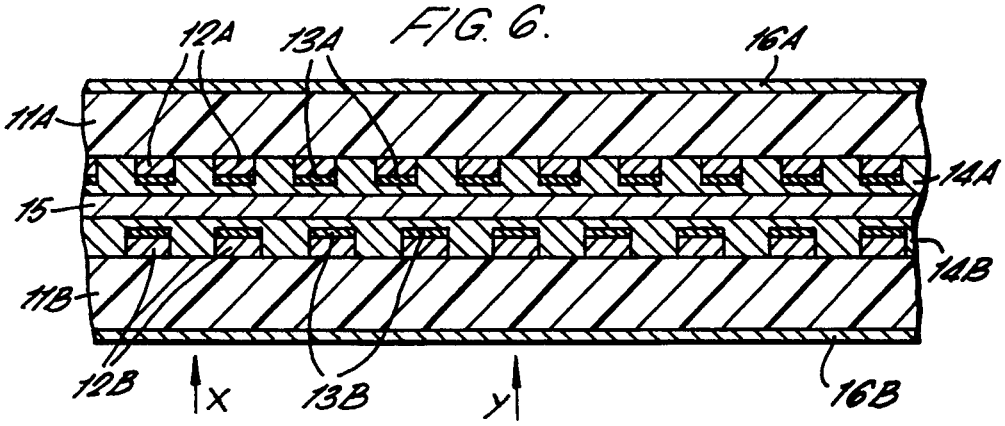
FIGS. 6 and 7 are longitudinal cross sections of additional embodiments of security elements according to the present invention.

Another embodiment of a thread to be used in accordance with paper of this invention is illustrated in FIG. 6. In this figure support layers 11A and 11B are provided on their outer sides with regions 16A and 16B which are transparent coatings which may be optionally coloured and/or luminescent and which provide protection to the structure and/or adhesive properties to bond the security thread to paper. On the inner side of support layers 11A and 11B are regions 12A and 12B, these being selectively metallised, e.g., comprising opaque copper of an optical density of 2.0 to 2.5 in the form of a bar or letter pattern as described previously. Regions 13A and 13B are the portions of resist remaining after an etching technique which removed metal adhered to the support layers; the resist may be clear or coloured. Regions 14A and 14B are transparent coatings which are optionally coloured and/or luminescent and which provide protection to the structure of the regions 12A and 12B. The central layer 15 is an adhesive which was used to form the security element as shown by uniting together the upper and lower layers.

The upper regions 12A are 1 mm in width and are spaced 1 mm apart whereas the corresponding lower regions 12B are 1.1 mm in width and 1.1 mm spaced apart. When the security element is positioned in paper and viewed with transmitted light at Y, no light is transmitted whereas when viewed at X light can pass through the security element to give a bright region.

EXAMPLE 6

In a further example, which is a modification of Example 5, with reference to FIG. 6, layers 11A and 11B are clear polyester, e.g. Melinex 840 ex ICI, 12 μm thick. Regions 12A and 12B are opaque aluminium with an optical density of 2.0 to 2.5. Regions 13A and B, 15 and 16A and B are colourless. Regions 14A and 14B are continuous layers of vacuum deposited aluminium to a combined optical density of 0.7.

When embedded in paper, the thread has an overall optical effect as described in Example 2. The advantage of the structure of this example is that the selectively metallised regions 12A and 12B are inside the laminate and thus gain enhanced resistance to mechanical and chemical attack.

EXAMPLE 7

In another example, referring to FIG. 6, regions 11A and 11B comprise 12 μm thick polyester, e.g. Melinex 800 ex ICI, dyed green. The other regions are as described for Example 6. The film is slit and incorporated into paper as previously described.

In reflected light, the thread has the appearance of a more-or-less uniformly reflective green strip; it may appear a little darker in regions X where the intervals between the selective opaque metallised regions 2A and 2B coincide. In transmitted light, regions at arrow X appear as bright green areas whereas regions at arrow Y are opaque; the intervening regions have some bright green areas according to the degree of overlap of regions 12A and 12B.

The mechanical/chemical durability benefits of Example 6 apply also to this example.

EXAMPLE 8

Figure 7:
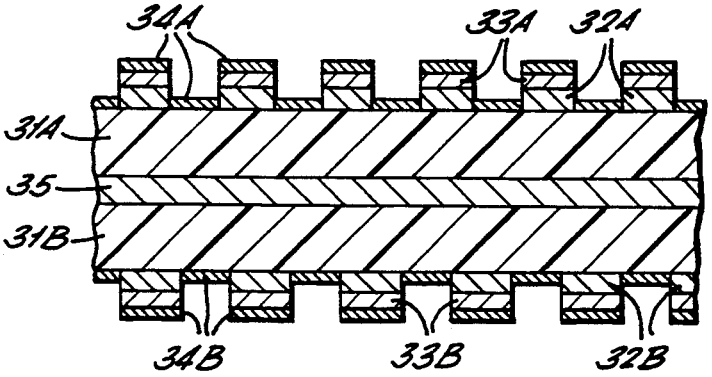

With reference to FIG. 7, a web of colourless 12 μm thick polyester 31A (e.g. EMBLET 1200) is vacuum coated with an opaque uniform layer of aluminium at an optical density of 2.0 to 2.5. The web is then partially demetallised to produce a bar pattern as described in Example 1. Conveniently, the bars are 1.0 mm wide and spaced 1.0 mm apart, as represented by regions 32 in FIG. 7. After demetallisation, the bars have a resist coating 33A on their upper surface. A partially transmitting layer of aluminium 34A of an optical density 0.6 is then deposited over the web on the selectively demetallised side in a further vacuum deposition operation, such that this second metal layer is present over the resist layers 33A and in between the opaque metal layers 32A; this partially transmitting layer is designated 34A.

A second web of 12 μm polyester 31B is processed in a similar manner; however, in this case, the opaque aluminium regions are 1.1 mm wide and spaced 1.1 mm apart.

The two webs are laminated together using a suitable adhesive 35 such that the metallised regions 32 and 34 are on the outside of the laminate as shown in FIG. 7. Protective and/or adhesive coatings may be added as described in previous examples.

The structure described in this example produces effects similar to that of Example 2, or Example 1 if layers 31A or 31B or both incorporate a green dye, but the partially transmitting aluminium layers 34 are now in the same side of the polyester support layer 31 as the selectively metallised regions 32.

The structure described for Example 8 and illustrated by FIG. 7 may be produced by a different route. For example, the polyester support layer 31A is uniformly metallised, selectively demetallised to produce regions 32A and then laminated to another layer, also previously metallised and selectively demetallised to produce regions 32B, before the low optical density regions 34 are vacuum deposited on each side of the laminate in turn. Alternatively, the support layer 31A is laminated to the second support layer 31B before each external surface of the laminate is uniformly metallised and selectively demetallised produce regions 32A and B and then layers 34A and B are applied.

EXAMPLE 9

With reference to FIG. 6, a security element is constructed according to Example 6; in this example however, regions 16 comprise an adhesive. A web of transparent flexible plastic is coated with a suitable adhesive by means of a roller coater and the security element drawn into the nip between roller and web. A second web of the same or a different transparent flexible plastic is then laminated under pressure by the action of a heated roller to the first web such that the security element is incorporated between the webs.

After further processing, which may include the provision of printing, further lamination and the affixing of photographs, the laminated web incorporating the security element is divided to form security identity badges.

In a variant, only one side of the security element is coated with an adhesive 16. The element is then placed on the surface of a web of transparent flexible plastic with the adhesive-coated side against the web and introduced into a heated roller nip to bond the element to the web. In use, the element remains on the surface of the security identity badges formed from the web.

For all examples described above, dyes/pigments may be added to regions 1, 3, 5, 6, 11, 13, 14, 15, 16, 31 and 35 to modify the actual colours observed. For all examples, luminescent materials may be added to these regions to further enhance the difficulty in simulating the thread, such luminescence to include fluorescence and phosphorescence and excitation by UV, IR, visible light or other radiation as appropriate.

It is also to be noted that the layer of aluminium in any of the Examples could be replaced with a nickel or other magnetic metal to produce a security element with magnetic properties.

I claim:

1. A security article which comprises at least one elongate security element, said security element being visually detectable in transmitted light to display portions which transmit light and portions which are opaque, wherein said security element comprises a plurality of layers including a light-transmitting layer and at least two series of opaque regions which are separated by said light-transmitting layer, wherein the opaque regions are arranged such that at certain parts of the security element said regions overlap to prevent light transmission and elsewhere along the length of the security element the opaque regions do not overlap or partially overlap such that light transmission through the security element can occur.

2. An article as claimed in claim 1 characterised in that the article is paper and the security element is either wholly embedded within said paper, or is partially embedded within said paper with portions thereof being exposed at the surface of the paper at spaced intervals along the length of the security element at windows or apertures in the paper.

3. An article as claimed in claim 1 characterised in that there is also positioned between said series of opaque regions at least one thin layer of metal which has an optical density of 0.1 to 1.2, said density being the combined density of thin layers, if there is more than one such layer.

4. An article as claimed in claim 3 characterised in that the optical density of said metal is 0.3 to 0.9.

5. An article as claimed in claim 1 characterised in that the opaque regions are provided by metal and have an optical density of 2.0 to 2.5.

6. An article as claimed in claim 5 characterised in that at least some of the metal components are a magnetic material.

7. An article as claimed in claim 1 characterised in that the opaque regions are aluminium.

8. An article as claimed in claim 1 characterised in that the security element is formed from two parts, one part bearing on one side of a light-transmitting support layer opaque, spaced-apart regions of aluminium and on the other side of the support layer a thin film of aluminium, which portion is adhered to another part which comprises a light-transmitting support layer having on one side a thin film of aluminium, the two layers of thin aluminium having a combined optical density of 0.15 to 1.0, and on the other side of the second support layer opaque spaced-apart regions of aluminium said two parts being united with an adhesive layer positioned between the two thin layers of aluminium.

9. An article as claimed in 8 characterised in that the opaque regions on one side of the security element have a width equal to the gap between said opaque regions and the other opaque regions have an equal width and gap which is 5 to 15% larger than the width of the first opaque regions.

10. An article as claimed in claim 1 characterised in that the support layer is a clear polymer and comprises a light-transmitting luminescent substance.

11. An article as claimed in claim 1 wherein the support layer is a clear polymer and comprises a light-transmitting colored substance.

12. An article as claimed in claim 1 wherein the support layer is a clear polymer and comprises a light-transmitting colored and luminescent substance.

13. An article as claimed in claim 1 characterised in that the security element is provided with an adhesive or lacquer layer on either side of said security element, or lacquer which adhesive layer may encapsulate opaque regions present in said security element.

14. An article as claimed in claim 11 characterised in that the adhesive or lacquer layer is clear.

15. An article as claimed in claim 13 wherein the adhesive or lacquer layer is colored.

16. An article as claimed in claim 13 wherein the adhesive or lacquer layer is luminescent.

17. An article as claimed in claim 13 wherein the adhesive or lacquer layer is colored and luminescent.

18. An article as claimed in claim 1 characterised by the provision of a light transmitting layer on each of the opaque regions.

19. An article as claimed in claim 18 wherein the light-transmitting layer on the opaque regions is a layer of resist which is colored.

20. An article as claimed in claim 18 wherein the light-transmitting layer on the opaque regions is a layer of resist which is luminescent.

21. An article as claimed in claim 18 wherein the light-transmitting layer on the opaque regions is a layer of resist which is colored and luminescent.

22. An article as claimed in claim 13 characterised in that the light transmitting layer on the opaque regions is a layer of resist which is clear.

23. An article as claimed in claim 1, comprising a security document to which said at least one elongated security element is attached, said security document being at least partially formed from synthetic fibres or by a laminate of at least two sheets or webs of material.

24. An article as claimed in claim 1, comprising a plastic element within which said at least one security element is at least partially embedded.

25. An article as claimed in claim 1, comprising a piece of paper within which said at least one elongate security element is at least partially embedded.

26. An article as claimed in claim 25, wherein said piece of paper comprises a banknote.

27. An article as claimed in claim 26, wherein said security element contains at least ten non-light-transmitting regions respectively separated by a light-transmitting region.

28. An article as claimed in claim 1 characterised in that the security element comprises a support layer having on one side a first series of opaque regions which are provided with a light-transmitting coating to encapsulate said opaque regions.

29. An article as claimed in claim 28 characterised in that said coating is bonded to a second coating which encapsulates a second series of opaque regions which second series of opaque regions has a second support layer in contact with said opaque regions.

30. An article as claimed in claim 28 characterised in that the light transmitting coating is clear.

31. An article as claimed in claim 28 wherein the light-transmitting coating is colored.

32. An article as claimed in claim 28 wherein the light-transmitting coating is luminescent.

33. An article as claimed in claim 28 wherein the light-transmitting coating is colored and luminescent.

34. An article as claimed in claim 28 wherein the light-transmitting layer is adhesive.

35. A security element which comprises a plurality of layers including a light-transmitting support layer and at least two series of opaque regions which are separated by said light-transmitting layer, wherein the opaque regions are arranged such that at certain parts of the security element the regions overlap to prevent light transmission and elsewhere along the length of the security element the opaque regions do not overlap or partially overlap such that light transmission through the security element can occur.

* * * * *